US009687971B2

(12) United States Patent
Yu et al.

(10) Patent No.: US 9,687,971 B2
(45) Date of Patent: Jun. 27, 2017

(54) HAND-DRIVEN MECHANICAL SCREWDRIVER

(71) Applicants: HONG FU JIN PRECISION INDUSTRY (ShenZhen) CO., LTD., Shenzhen (CN); HON HAI PRECISION INDUSTRY CO., LTD., New Taipei (TW)

(72) Inventors: Long Yu, Shenzhen (CN); Fang-Quan Li, Shenzhen (CN)

(73) Assignees: HONG FU JIN PRECISION INDUSTRY (ShenZhen) CO., LTD., Shenzhen (CN); HON HAI PRECISION INDUSTRY CO., LTD., New Taipei (TW)

( * ) Notice: Subject to any disclaimer, the term of this patent is extended or adjusted under 35 U.S.C. 154(b) by 349 days.

(21) Appl. No.: 14/517,436

(22) Filed: Oct. 17, 2014

(65) Prior Publication Data

US 2015/0151414 A1 Jun. 4, 2015

(30) Foreign Application Priority Data

Nov. 30, 2013 (CN) ..... 2013 1 06223795

(51) Int. Cl.
*B25B 15/06* (2006.01)

(52) U.S. Cl.
CPC ..... *B25B 15/06* (2013.01)

(58) Field of Classification Search
CPC ..... B25B 15/06
USPC ..... 81/449
See application file for complete search history.

(56) References Cited

U.S. PATENT DOCUMENTS 1,213,733 A * 1/1917 Braunbeck ..... B25B 15/06 15/25
1,630,976 A * 5/1927 Smith ..... B25B 15/06 74/127
2,474,377 A * 6/1949 Shurtleff ..... B25B 13/46 408/121
2,521,816 A * 9/1950 Adams ..... B25B 15/06 408/120
2,684,698 A * 7/1954 Shaff ..... B25B 23/10 81/453

(Continued)

FOREIGN PATENT DOCUMENTS

CN 103231341 A 8/2013
JP H09254044 A 9/1997
TW M443602 U1 12/2012

*Primary Examiner* — Hadi Shakeri
(74) *Attorney, Agent, or Firm* — Steven Reiss

(57) ABSTRACT

A hand-driven mechanical screwdriver includes a holding assembly, a drive mechanism supported by the holding assembly, and a working element. The holding assembly includes a bracket and a sliding channel defined in the bracket. The drive mechanism includes a connecting element and a screw rod threadably engaged within the connecting element. An activator is rotatably connected to the connecting element and slidably positioned within the holding assembly bracket sliding channel. The working element is attached to the second end of the screw rod. When the activator is slid along the sliding channel, the connecting element moves from near the second end of the bracket towards the first end of the bracket rotating the threadably engaged screw rod and the working element attached to the screw rod.

19 Claims, 4 Drawing Sheets

(56) References Cited

U.S. PATENT DOCUMENTS 3,687,179 A * 8/1972 Totsu ..... B25B 21/00
81/436

* cited by examiner

HAND-DRIVEN MECHANICAL SCREWDRIVER

FIELD

The subject matter herein generally relates to a mechanical device.

BACKGROUND

In mechanical processing, a screw is widely used as a joining member. To improve operating efficiency and reduce labor cost, it is necessary to apply a screwdriver to screw or unscrew the screw.

BRIEF DESCRIPTION OF THE DRAWINGS

Implementations of the present technology will now be described, by way of example only, with reference to the attached figures, wherein.

DETAILED DESCRIPTION

Figure 1:
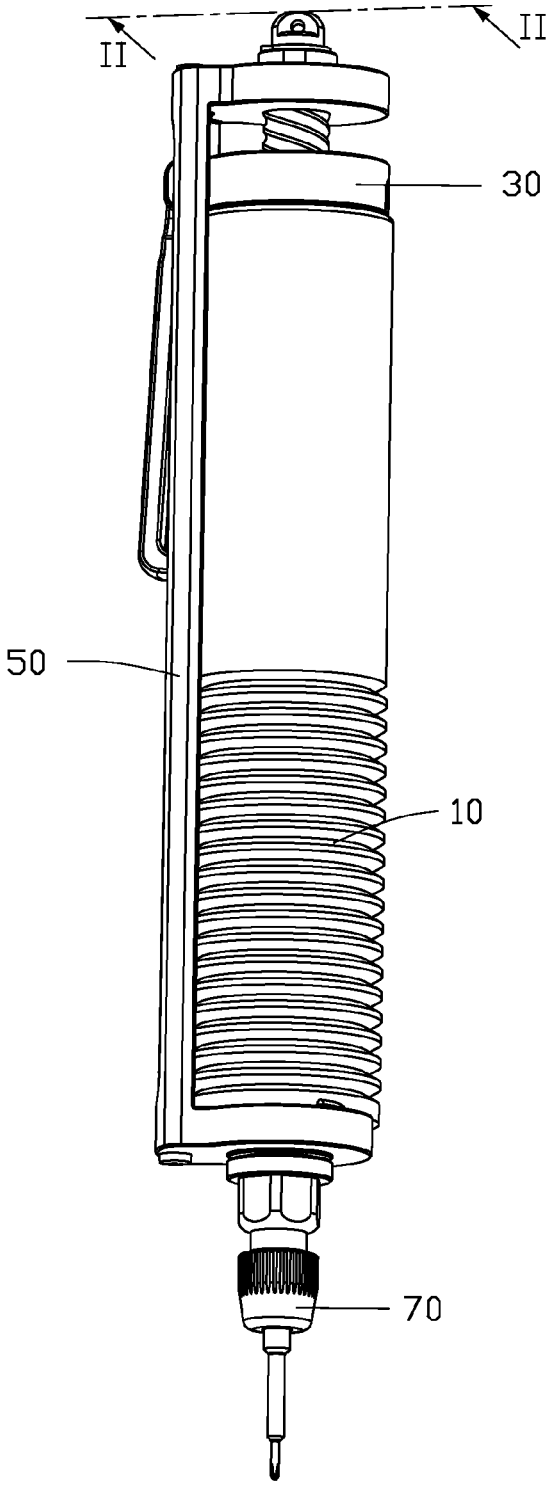
FIG. 1 is an isometric view of a hand-driven mechanical screwdriver according to an embodiment of the present disclosure.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. Also, the description is not to be considered as limiting the scope of the embodiments described herein. The drawings are not necessarily to scale and the proportions of certain parts may be exaggerated to better illustrate details and features of the present disclosure.

Several definitions that apply throughout this disclosure will now be presented.

The term "coupled" is defined as connected, whether directly or indirectly through intervening components, and is not necessarily limited to physical connections. The connection can be such that the objects are permanently connected or releasably connected. The term "outside" refers to a region that is beyond the outermost confines of a physical object. The term "inside" indicates that at least a portion of a region is partially contained within a boundary formed by the object. The term "substantially" is defined to be essentially conforming to the particular dimension, shape, or other word that substantially modifies, such that the component need not be exact. For example, substantially cylindrical means that the object resembles a cylinder, but can have one or more deviations from a true cylinder. The term "comprising", when utilized, means "including, but not necessarily limited to"; it specifically indicates open-ended inclusion or membership in the so-described combination, group, series and the like.

The present disclosure is described in relation to a hand-driven mechanical screwdriver.

FIG. 1 illustrates a hand-driven mechanical screwdriver 100 can include a housing 10, a driving mechanism 30, a holding assembly 50, and a working element 70 driven by the driving mechanism 30. The driving mechanism 30 can be movably connected to the housing 10 and partially received inside the housing 10. The driving mechanism 30 can be configured to drive the working element 70 to rotate. The holding assembly 50 can be connected to an exterior of the driving mechanism 30. The holding assembly 50 can be configured to control the movement of the driving mechanism 30 and to secure the housing 10 and the driving mechanism 30. The working element 70 can be connected to an end of the driving mechanism 30 and can be exposed outside the housing 10. The working element 70 can be configured to be driven by the driving mechanism 30 and engage with a screw for fastening.

Figure 2:
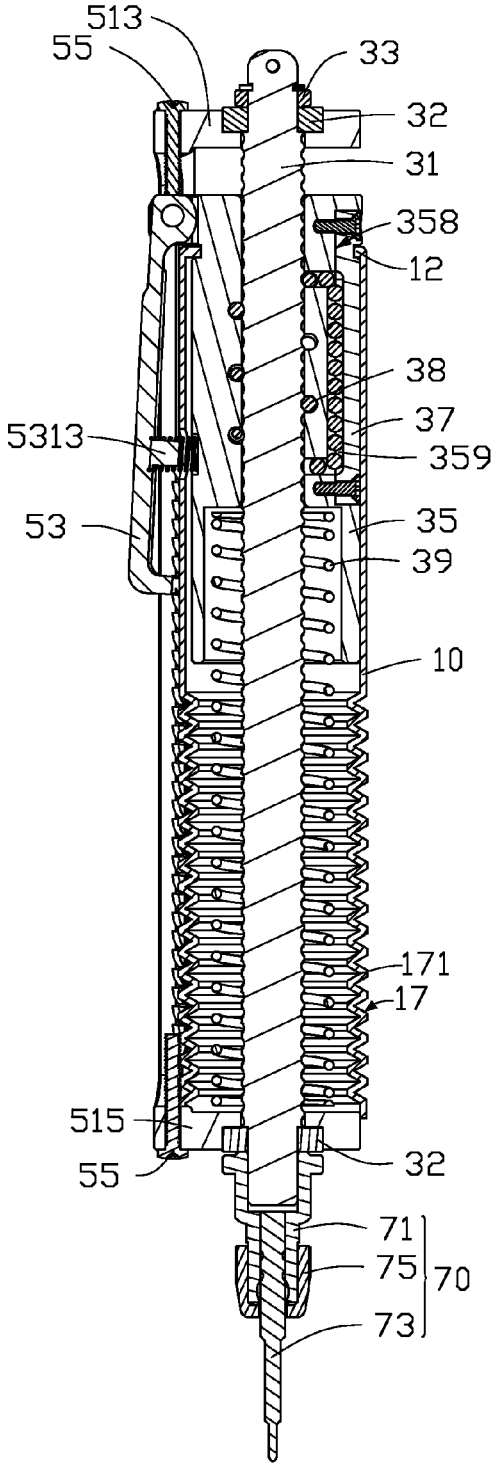
FIG. 2 is a cross-sectional view of the hand-driven mechanical screwdriver shown in FIG. 1 taken along line II-II.
Figure 3:
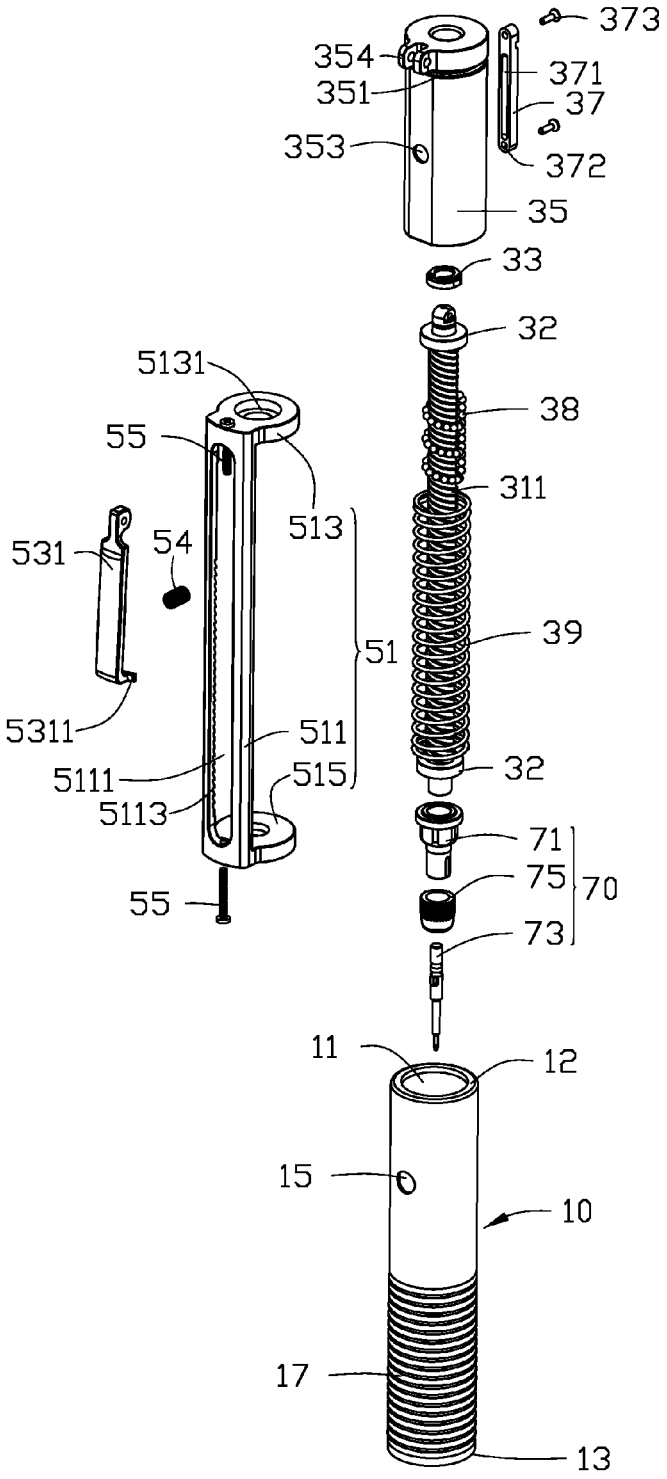
FIG. 3 is an exploded, isometric view of the hand-driven mechanical screwdriver shown in FIG. 1.

FIGS. 2-3 illustrate that the housing 10 can be hollow, substantially cylindrical and include a first end portion 11 and a second end portion 13 facing each other. The housing 10 can further include a latching portion 12 connected to the first end portion 11. The latching portion 12 can be substantially circular and substantially perpendicularly extend to an axis of the housing 10 from the first end portion 11.

The housing 10 can further include a through hole 15 adjacent to the first end portion 11, and an elastic portion 17 adjacent to the second end portion 13. The elastic portion 17 can have a plurality of folds 171 evenly distanced from each other, configured to provide an elastic property for the housing 10. When a downward pressure is applied to the first end portion 11, the second end portion 13 can be vertically compressed and adjusted to a compressed state. When the applied pressure is removed, the second end portion 13 can rebound to a relaxed state. In other embodiments, the elastic portion 17 can be made of an elastic material, such as a rubber or plastic.

The driving mechanism 30 can include a screw rod 31, two bearings 32, and a fixing element 33. The screw rod 31 can pass through the housing 10 and extend outside the first end portion 11 and second end portion 13. The screw rod 31 can define a plurality of first helical grooves 311 in an exterior surface. The two bearings 32 can be coiled on either end of the screw rod 31 and be positioned respectively adjacent to the first end portion 11 and second end portion 13. The fixing element 33 can be coiled around an end of the screw rod 31 adjacent to the first end portion 11. The fixing element 33 can be stacked on the bearing 32 adjacent to the first end portion 11, configured to secure the bearing 32. In at least one embodiment, the fixing element 33 can be a screw nut.

The driving mechanism 30 can further include a connecting element 35, a plug block 37, a plurality of ball bearings 38, and a resetting element 39. The connecting element 35 can be hollow and substantially cylindrical, and can be received inside the housing 10. The connecting element 35 can be coiled around the screw rod 31 and threadedly engage the screw rod 31. The connecting element 35 can define a substantially circular latching groove 351 to receive and engage the latching portion 12. The connecting element 35 can be coupled to the housing 10 by the engagement of the latching groove 351 and latching portion 12, and at the same time can keep contaminants such as dust from entering. The connecting element 35 can further define a connecting portion 354 and a resisting portion 353. The connecting portion 354 can be defined adjacent to the latching groove 351. The connecting portions 354 can be a pair of projections substantially projecting from a periphery of the connecting element 35 in a radial direction. The resisting portion 353 can be located axially facing the connecting portion 354. The latching groove 351 can be located between the resisting portion 353 and the connecting portion 354.

An opening 358 can be defined in the periphery of the connecting element 35 can be configured to receive the plug block 37. The opening 358 can be substantially parallel with an axial direction of the connecting element 35. The opening 358 and resisting portion 353 can be located in opposite radial sides of the connecting element 35. The plug block 37 can mate with the opening 358 and can be received in the opening 358. The plug block 37 can prevent ball bearings 38 from moving out. Furthermore, the plug block 37 can define a slot 371 in a middle portion, two fixing holes 372, and two fixing members 373 to engage the fixing holes 372. The slot 371 can be configured to receive the ball bearings 38 and can match size and shape of the ball bearings 38. The two fixing holes 372 can be located away from the slot 371 at either end of the plug block 37. The fixing member 373 can be inserted into the fixing hole 372 to connect the plug block 37 to the connecting element 35.

The connecting element 35 can further define a ball bearing sliding slot 359. The ball bearing sliding slot 359 can be a cyclic channel to allow the ball bearings 38 to roll. The ball bearing sliding slot 359 can be partially formed by the slot 371 functioning as a part of the ball bearing sliding slot 359. A remaining part of the ball bearing sliding slot 359 can be defined between the screw rod 31 and the connecting element 35, and can be cooperatively formed by an inner side of the connecting element 35 and a plurality of the first helical grooves 311 of the screw rod 31. The resetting element 39 can be hollow and elastic. The resetting element 39 can be coiled around the screw rod 31 and can be received inside the housing 10. The resetting element 39 can be located adjacent to the second end portion 13. In at least one embodiment, the resetting element 39 can be a spring.

The holding assembly 50 can include a bracket 51, an activator 53, an elastic member 54, and two control members 55. The bracket 51 can include a main body 511, a first supporting seat 513 and a second supporting seat 515. The main body 511 can be installed outside and can be connected to the housing 10. The main body 511 can define a substantially oval sliding channel 5111 in the axial direction. The main body 511 can further define a first engaging portion 5113 along the inner periphery of the sliding channel 5111. The first engaging portion 5113 can be substantially sawtooth shaped.

The first supporting seat 513 and second supporting seat 515 can be hollow and substantially cylindrical, and located on opposite ends of the bracket 51 extending to substantially a same direction. The first supporting seat 513 and second supporting seat 515 can be substantially perpendicular to the main body 511 and extend to the driving mechanism 30. The first supporting seat 513 can include a substantially circular flange 5131 and can be configured to support the bearing 32 adjacent to the first end portion 11. The flange 5131 can be positioned inside the first supporting seat 513. The screw rod 31 can pass through the first supporting seat 513 and second supporting seat 515, and either end of the screw rod 31 can be rotatably installed on the first supporting seat 513 and second supporting seat 515 via the two bearings 32.

The activator 53 can be substantially "L" shaped. The activator 53 can be received inside the sliding channel 5111 to engage the first engaging portion 5113. The activator 53 can include a rod portion 531, and the rod portion 531 can define a second engaging portion 5311 to engage the first engaging portion 5113. An end of the rod portion 531 can be connected to the connecting portion 354.

The activator 53 can further define a block 5313 to engage the elastic member 54. The elastic member 54 can be hollow and substantially cylindrical. In one embodiment, the elastic member 54 can be a spring. The elastic member 54 can be coiled around the block 5313. An end of the elastic member 54 adjacent to the activator 53 can resist against the rod portion 531, and an end of the elastic member 54 extending to the screw rod 31 can pass through the through hole 15 to resist against the resisting portion 353. When a pressure is exerted on the activator 53, the elastic member 54 can be compressed to release the second engaging portion 5311 from the first engaging portion 5113. Thus, the activator 53 can be adjusted to be movable in the sliding channel 5111, and in this situation the connecting element 35 can be exerted with a downward pressure to move downward. When the pressure exerted on the activator 53 is removed, the elastic member 54 can rebound to drive the second engaging portion 5311 to engage the first engaging portion 5113. Thus the activator 53 can be adjusted to be immobile in the sliding channel 5111.

The two control members 55 can be fixed on opposite ends of main body 511 and extend into the sliding channel 5111. In one embodiment, the control member 55 can be a screw. One control member 55 away from the working element 70 can abut against the activator 53. A length of the control member 55 extending into the sliding channel 5111 can be variable to adjust the movement of the activator 53 in the sliding channel 511 whereby a sliding length of the activator 53 in the sliding channel 511 can be adjusted. Each control member 55 can have a reserved length which is convenient for adjustment.

The working element 70 can be installed on the screw rod 31 adjacent to the second supporting seat 515. The working element 70 can include a rotary joint 71, a working portion 73, and a connecting portion 75. An end of the rotary joint 71 can be coiled around the end of the screw rod 31 adjacent to the second supporting seat 515. The working portion 73 can be inserted into and connected to an end of the rotary joint 71 adjacent the second supporting seat 515. The connecting portion 75 can be coiled on a joint of the rotary joint 71 and the working portion 73. The connecting portion 75 can be configured to prevent a loosening of the joint of the rotary joint 71 and working portion 73 and enhance the joint of the two. In at least one embodiment, the working portion 73 can be a hand-driven mechanical screwdriver bit.

Figure 4:
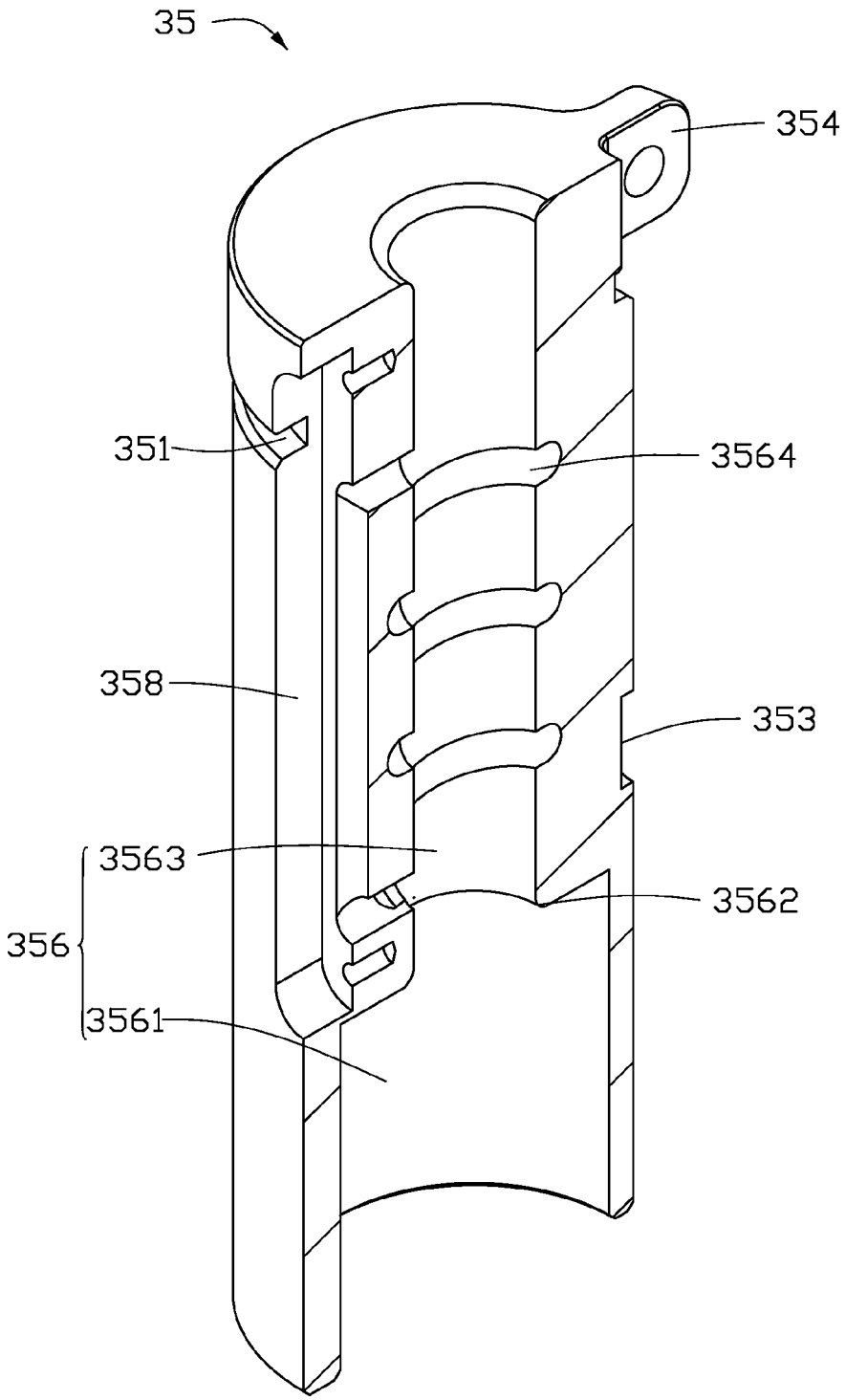
FIG. 4 is a cross-sectional, isometric view of a connecting element of the hand-driven mechanical screwdriver shown in FIG. 3.

FIG. 4 illustrates that the connecting element 35 can further define a receiving channel 356. The receiving channel 356 can include a first receiving channel 3561, a second receiving channel 3563, and a shaft shoulder 3562 between the two. The first receiving channel 3561 can be located inside an end of the connecting element 35 away from the connecting portion 354. The second receiving channel 3563 can be located inside an end of the connecting element 35 adjacent to the connecting portion 354. The first receiving channel 3561 can communicate with the second receiving channel 3563 in the axial direction. A diameter of the first receiving channel 3561 can be greater than the second receiving channel 3563. The shaft shoulder 3562 can be located in the joint of the first receiving channel 3561 and the second receiving channel 3563, and can be connected to first receiving channel 3561 and the second receiving channel 3563. One end of the resetting element 39 (shown in FIG. 3) away from the working element 70 can be inserted into the first receiving channel 3561 and resist against the shaft shoulder 3562.

The receiving channel 356 can further define a plurality of second helical grooves 3564 to engage the first helical grooves 311 (shown in FIG. 3). The second helical grooves 3564 can be located inside the second receiving channel 3563 and distanced evenly from each other. The second helical grooves 3564, the first helical grooves 311, and the slot 371 can cooperatively form the ball bearing sliding slot 359 which is a cycling channel to receive the ball bearings 38 and allow the rolling ball bearings 38 to roll (shown in FIGS. 2-3), when the downward pressure is exerted on the connecting element 35 to allow the connecting element 35 to move axially, by the threaded engagement of the connecting element 35 with the screw rod 31, the screw rod 31 can be driven to rotate relative to the connecting element 35. At the same time, the ball bearings 38 can roll in the cyclic ball bearing sliding slot 359 cooperatively formed by the second helical grooves 3564, the first helical grooves 311, and the slot 371. The rolling of the ball bearings 38 between the connecting element 35 and the screw rod 31 can generate a rolling friction instead of a sliding friction, for reducing the necessary prior downward pressure to allow the connecting element 35 to move, improving the driving effects and driving accuracy between the connecting element 35 and the screw rod 31. (shown in FIG. 2).

In assembly, the connecting element 35 and the resetting element 39 can be coiled around in the screw rod 31 and be received in the housing 10, and the latching portion 12 can be latched in the latching groove 351 to connect the connecting element 35 to the housing 10. Either opposite ends of the screw rod 31 can be connected to the two bearings 32, and can pass through the bracket 51 to be rotatably coupled to first supporting seat 513 and second supporting seat 515 by the two bearings 32. The resetting element 39 can be inserted into the first receiving channel 3561 and be restricted between the shaft shoulder 3562 and second supporting seat 515. The elastic member 54 can be coiled around the block 5313 and restricted between the activator 53 and the resisting portion 353. An end of the activator 53 adjacent to the first supporting seat 513 can be fixed to the connecting portion 354. The rotary joint 71 can be coiled on the screw rod and the working portion 73 can be inserted into an end of the rotary joint 71 adjacent the second supporting seat 515, to be installed on the screw rod 31. The connecting portion 75 can be coiled on the joint of the rotary joint 71 and the working portion 73. Thus, an assembly of the screw device 100 can be completed.

In operation, the working portion 73 can be resisted against a head of a screw to be fastened, and the activator 53 can be pressed downward and moved along the sliding channel 5111 to the working portion 73. In this situation, the connecting element 35 can be moved downward by the activator 53 to elastically compress the resetting element 39 and the housing 10. Thus, the screw rod 31 can be driven by the connecting element 35 to rotate relative to the connecting element 35, and the working portion 73 can rotate with a rotation of the screw rod 31 to fasten the screw.

When the screw is fastened, the activator 53 can be released and the second engaging portion 5311 can engage the first engaging portion 5113 and be latched by the first engaging portion 5113. In this situation, the screw rod 31 and the working portion 73 can be immobile. When the working portion 73 is moved away from the head of the fastened screw, the activator 53 again can be compressed to drive the connecting element 35 and the housing 10 to reset by a rebounding elastic portion 17 and resetting element 39.

In other embodiments, the second engaging portion 5311 and the first engaging portion 5113 can be omitted and the activator 53 can be adjusted to be immobile by a way of an exerted pressure.

In other embodiments, the elastic member 54 can be omitted and the activator 53 can be reset manually.

In other embodiments, the through hole 15 of the housing 10 can be omitted and the elastic member 54 can directly resist between the resisting portion 353 of the connecting element 35 and the rod portion 531.

In other embodiments, the resetting element 39 can be omitted. When the activator 53 moves away from the working portion 73 after performing a fastening operation, the connecting element 35 can be reset by the activator 53.

The hand-driven mechanical screwdriver 100 can adjust the motion of the activator 53 to control a rotary speed and a rotary number of the working portion 73.

The embodiments shown and described above are only examples. Many details are often found in the art such as the other features of a hand-driven mechanical screwdriver. Therefore, many such details are neither shown nor described. Even though numerous characteristics and advantages of the present technology have been set forth in the foregoing description, together with details of the structure and function of the present disclosure, the disclosure is illustrative only, and changes may be made in the detail, including in matters of shape, size and arrangement of the parts within the principles of the present disclosure up to, and including the full extent established by the broad general meaning of the terms used in the claims. It will therefore be appreciated that the embodiments described above may be modified within the scope of the claims.

What is claimed is:

1. A hand-driven mechanical screwdriver comprising:

a holding assembly having:

a bracket with a first end and a second end, and with a sliding channel extending in a direction substantially from the first end to the second end defined in the bracket;

a driving mechanism supported by the holding assembly, the driving mechanism having:

a connecting element;

a screw rod threadably engaged within the connecting element, the screw rod having a first end and a second end; and an activator pivoted on the connecting element and slidably positioned within the holding assembly bracket sliding channel;

a working element attached to the second end of the screw rod;

a housing positioned around the driving mechanism; and an end of the housing adjacent to the working element defines an elastic portion;

wherein, when the activator is slid along the sliding channel, the connecting element moves from near the second end of the bracket towards the first end of the bracket rotating the threadably engaged screw rod and the working element attached to the screw rod.

2. The hand-driven mechanical screwdriver as claimed in claim 1, wherein, the screw rod further defines a plurality of first helical grooves in an exterior surface;

the connecting element defines a receiving channel, the receiving channel defines a plurality of second helical grooves to engage the first helical grooves; and the driving mechanism comprises a plurality of ball bearings received in the second helical groove.

3. The hand-driven mechanical screwdriver as claimed in claim 2, wherein, the receiving channel comprises:

a first receiving channel positioned in an end of the connecting element adjacent to the working element;

a second receiving channel communicated to the first receiving channel and positioned in an end of the connecting element away from the working element; and a shaft shoulder located between and connected to the first receiving channel and second receiving channel;

wherein, a diameter of the first receiving channel is greater than that of the second receiving channel, and the second helical groove is positioned in the second receiving channel.

4. The hand-driven mechanical screwdriver as claimed in claim 3, wherein, the driving mechanism further comprises a resetting element coiled on an end of the screw rod adjacent to the working element, and the resetting element is resisted against and located between the bracket and shaft shoulder.

5. The hand-driven mechanical screwdriver as claimed in claim 2, wherein, the driving mechanism further comprises a plug block, and the connecting element further defines an opening configured to receive the plug block.

6. The hand-driven mechanical screwdriver as claimed in claim 5, wherein, the plug block comprises a slot in a middle portion configured to receive the ball bearings.

7. The hand-driven mechanical screwdriver as claimed in claim 1, wherein, the sliding channel further defines a first engaging portion along an inner periphery of the sliding channel; and the activator further defines a second engaging portion to engage the first engaging portion.

8. The hand-driven mechanical screwdriver as claimed in claim 7, wherein, the activator further comprises a block and the holding assembly further comprises an elastic member coiled on the block; one end of the elastic member is resisted against the activator and the opposite end of the elastic member is resisted against the connecting element.

9. The hand-driven mechanical screwdriver as claimed in claim 8, wherein, the connecting element further defines a resisting portion to resist against the elastic member.

10. The hand-driven mechanical screwdriver as claimed in claim 1, wherein, the elastic portion comprises a plurality of folds evenly distanced from each other.

11. The hand-driven mechanical screwdriver as claimed in claim 1, wherein, an end of the housing defines a latching portion and the connecting element defines a latching groove to engage the latching portion to couple the housing to the connecting element.

12. The hand-driven mechanical screwdriver as claimed in claim 1, wherein, the bracket comprises:

a main body;

a first supporting seat; and a second supporting seat extending to a same direction as the first supporting seat; and the sliding channel is defined in an axial direction of the main body, and the screw rod is rotatably positioned through the first supporting seat and the second supporting seat.

13. The hand-driven mechanical screwdriver as claimed in claim 12, wherein, the holding assembly further comprises two control elements positioned on opposite ends of the main body and extending into the sliding channel.

14. The hand-driven mechanical screwdriver as claimed in claim 1, wherein, the working element comprises:

a rotary joint connected to an end of the screw rod away from the connecting element;

a working portion connected to an end of the rotary joint away from the screw rod; and a connecting portion coiled on a joint of the rotary joint and the working portion.

15. A hand-driven mechanical screwdriver comprising:

a holding assembly having:

a bracket with a first end and a second end, and with a sliding channel extending in a direction substantially from the first end to the second end defined in the bracket;

a driving mechanism supported by the holding assembly, the driving mechanism having:

a connecting element comprising a connecting portion;

a screw rod threadably engaged within the connecting element, the screw rod having a first end a second end; and an activator comprising a rod portion pivoted to the connecting portion of the connecting element and slidably positioned within the holding assembly bracket sliding channel;

a working element attached to the second end of the screw rod;

a housing positioned around the driving mechanism; and an end of the housing adjacent to the working element defines an elastic portion;

wherein, when the activator is slid along the sliding channel, the connecting element moves from near the second end of the bracket towards the first end of the bracket rotating the threadably engaged screw rod and the working element attached to the screw rod.

16. The hand-driven mechanical screwdriver as claimed in claim 15, wherein, the screw rod further defines a plurality of first helical grooves in an exterior surface;

the connecting element defines a receiving channel, the receiving channel defines a plurality of second helical grooves to engage the first helical grooves; and the driving mechanism comprises a plurality of ball bearings received in the second helical groove.

17. The hand-driven mechanical screwdriver as claimed in claim 16, wherein, the receiving channel comprises:

a first receiving channel positioned in an end of the connecting element adjacent to the working element;

a second receiving channel communicated to the first receiving channel and positioned in an end of the connecting element away from the working element; and a shaft shoulder located between and connected to the first receiving channel and second receiving channel;

wherein, a diameter of the first receiving channel is greater than that of the second receiving channel, and the second helical groove is positioned in the second receiving channel.

18. The hand-driven mechanical screwdriver as claimed in claim 17, wherein, the driving mechanism further comprises a resetting element coiled on an end of the screw rod adjacent to the working element, and the resetting element is resisted against and located between the bracket and the shaft shoulder.

19. The hand-driven mechanical screwdriver as claimed in claim 15, wherein, the sliding channel further defines a first engaging portion along an inner periphery of the sliding channel; and the activator further defines a second engaging portion to engage the first engaging portion.

* * * * *